US008648706B2

(12) United States Patent
Ranjun et al.

(10) Patent No.: US 8,648,706 B2
(45) Date of Patent: Feb. 11, 2014

(54) ALARM MANAGEMENT SYSTEM HAVING AN ESCALATION STRATEGY

(75) Inventors: Prabhat Ranjun, Bangalore (IN); Barnali Chetia, Bangalore (IN); Mahesh Tripathy, Bangalore (IN)

(73) Assignee: Honeywell International Inc., Morristown, NJ (US)

( * ) Notice: Subject to any disclaimer, the term of this patent is extended or adjusted under 35 U.S.C. 154(b) by 773 days.

(21) Appl. No.: 12/822,997

(22) Filed: Jun. 24, 2010

(65) Prior Publication Data

US 2011/0316688 A1 Dec. 29, 2011

(51) Int. Cl.
*G08B 23/00* (2006.01)

(52) U.S. Cl.
USPC ..... 340/500; 340/517; 340/521; 340/540; 340/573.1

(58) Field of Classification Search
USPC ..... 340/506, 517, 521, 531, 573.1, 500, 340/540
See application file for complete search history.

(56) References Cited

U.S. PATENT DOCUMENTS

| | | | |
|---|---|---|---|
| 4,375,637 | A | 3/1983 | Desjardins |
| 4,816,208 | A | 3/1989 | Woods et al. |
| 5,042,265 | A | 8/1991 | Baldwin et al. |
| 5,161,387 | A | 11/1992 | Metcalfe et al. |
| 5,385,297 | A | 1/1995 | Rein et al. |
| 5,390,206 | A | 2/1995 | Rein et al. |
| 5,768,119 | A | 6/1998 | Havekost et al. |
| 5,929,761 | A | 7/1999 | Van der Laan et al. |
| 5,946,303 | A | 8/1999 | Watson et al. |
| 5,955,946 | A | 9/1999 | Beheshti et al. |
| 6,124,790 | A | 9/2000 | Golov et al. |
| 6,178,362 | B1 | 1/2001 | Woolard et al. |
| 6,185,483 | B1 | 2/2001 | Drees |
| 6,223,544 | B1 | 5/2001 | Seem |
| 6,295,527 | B1 | 9/2001 | McCormack et al. |
| 6,314,328 | B1 | 11/2001 | Powell |
| 6,351,213 | B1 | 2/2002 | Hirsch |
| 6,356,282 | B2 * | 3/2002 | Roytman et al. ..... 715/736 |
| 6,420,968 | B1 | 7/2002 | Hirsch |
| 6,430,712 | B2 | 8/2002 | Lewis |

(Continued)

FOREIGN PATENT DOCUMENTS

| | | |
|---|---|---|
| WO | WO 01/97146 | 12/2001 |
| WO | WO 02/052432 | 7/2002 |

(Continued)

OTHER PUBLICATIONS

Honeywell, "Excel Building Supervisor-Integrated R7044 and FS90 Ver. 2.0," Operator Manual, 70 pages, Apr. 1995.

(Continued)

*Primary Examiner* — Hung T. Nguyen
(74) *Attorney, Agent, or Firm* — Seager Tufte & Wickhem LLC.

(57) ABSTRACT

An alarm management system having an escalation strategy which may be applied to each state of an alarm and increase a level of escalation if a required action has not been taken in response to an alarm. This approach is for avoiding an overlooking of any alarms and for assuring closure of alarms as soon as possible. An alarm may be in one of several intermediate states. Each state may have a threshold which if exceeded escalates an alarm's urgency. Alarm notifications may be provided to recipients according to their preferences.

11 Claims, 2 Drawing Sheets

(56) References Cited

U.S. PATENT DOCUMENTS

| | | | | |
|---|---|---|---|---|
| 6,473,407 | B1 | 10/2002 | Ditmer et al. | |
| 6,492,901 | B1 | 12/2002 | Ridolfo | |
| 6,535,122 | B1 | 3/2003 | Bristol | |
| 6,549,135 | B2 | 4/2003 | Singh et al. | |
| 6,675,591 | B2 | 1/2004 | Singh et al. | |
| 6,681,156 | B1 | 1/2004 | Weiss | |
| 6,690,980 | B2 | 2/2004 | Powell | |
| 6,816,811 | B2 | 11/2004 | Seem | |
| 6,870,141 | B2 | 3/2005 | Damrath et al. | |
| 6,879,253 | B1 | 4/2005 | Thuillard | |
| 6,892,546 | B2 | 5/2005 | Singh et al. | |
| 6,919,809 | B2 | 7/2005 | Blunn et al. | |
| 6,947,972 | B2 | 9/2005 | Chun | |
| 6,955,302 | B2 | 10/2005 | Erdman, Jr. | |
| 6,973,627 | B1 | 12/2005 | Appling | |
| 6,990,821 | B2 | 1/2006 | Singh et al. | |
| 7,024,283 | B2 | 4/2006 | Bicknell | |
| 7,062,389 | B2 | 6/2006 | Johnson et al. | |
| 7,068,931 | B2 | 6/2006 | Tokunaga | |
| 7,069,181 | B2 | 6/2006 | Jerg et al. | |
| 7,085,674 | B2 | 8/2006 | Iwasawa | |
| 7,113,085 | B2 | 9/2006 | Havekost | |
| 7,171,287 | B2 | 1/2007 | Weiss | |
| 7,243,044 | B2 | 7/2007 | McCalla | |
| 7,250,856 | B2 | 7/2007 | Havekost et al. | |
| 7,277,018 | B2 | 10/2007 | Reyes et al. | |
| 7,345,580 | B2 | 3/2008 | Akamatsu et al. | |
| 7,457,869 | B2 | 11/2008 | Kernan | |
| 7,460,020 | B2 | 12/2008 | Reyes et al. | |
| 7,596,613 | B2 | 9/2009 | Silverthorne et al. | |
| 7,653,459 | B2 | 1/2010 | Pouchak et al. | |
| 7,819,334 | B2 | 10/2010 | Pouchak et al. | |
| 7,826,929 | B2 | 11/2010 | Wacker | |
| 2002/0163427 | A1* | 11/2002 | Eryurek et al. | 340/500 |
| 2003/0101009 | A1 | 5/2003 | Seem | |
| 2003/0171851 | A1 | 9/2003 | Brickfield et al. | |
| 2004/0143510 | A1 | 7/2004 | Haeberle et al. | |
| 2005/0038571 | A1 | 2/2005 | Brickfield et al. | |
| 2005/0043862 | A1 | 2/2005 | Brickfield et al. | |
| 2005/0193285 | A1 | 9/2005 | Jeon | |
| 2005/0203490 | A1 | 9/2005 | Simonson | |
| 2006/0136558 | A1 | 6/2006 | Sheehan et al. | |
| 2006/0168013 | A1 | 7/2006 | Wilson et al. | |
| 2006/0187032 | A1* | 8/2006 | Kunkel et al. | 340/539.22 |
| 2006/0253205 | A1 | 11/2006 | Gardiner | |
| 2008/0010049 | A1 | 1/2008 | Pouchak et al. | |
| 2008/0016493 | A1 | 1/2008 | Pouchak et al. | |
| 2008/0115153 | A1 | 5/2008 | Brindle | |
| 2008/0125914 | A1 | 5/2008 | Wacker | |
| 2009/0113037 | A1 | 4/2009 | Pouchak | |
| 2009/0193436 | A1* | 7/2009 | Du et al. | 719/318 |
| 2010/0100583 | A1 | 4/2010 | Pouchak | |
| 2010/0106543 | A1 | 4/2010 | Marti | |
| 2010/0131653 | A1 | 5/2010 | Dharwada et al. | |
| 2010/0131877 | A1 | 5/2010 | Dharwada et al. | |
| 2010/0287130 | A1* | 11/2010 | Guralnik et al. | 706/47 |
| 2011/0010654 | A1 | 1/2011 | Raymond et al. | |
| 2011/0298608 | A1* | 12/2011 | Ranjan et al. | 340/519 |

FOREIGN PATENT DOCUMENTS

| | | |
|---|---|---|
| WO | WO 03/090038 | 10/2003 |
| WO | WO 2004/053772 | 6/2004 |
| WO | WO 2004/055608 | 7/2004 |
| WO | WO 2004/070999 | 8/2004 |
| WO | WO 2005/020167 | 3/2005 |
| WO | WO 2006/048397 | 5/2006 |
| WO | WO 2007/024622 | 3/2007 |
| WO | WO 2007/024623 | 3/2007 |
| WO | WO 2007/027685 | 3/2007 |
| WO | WO 2007/082204 | 7/2007 |

OTHER PUBLICATIONS

Trane, "System Programming, Tracer Summit Version 14, BMTW-SVP01D-EN," 623 pages, 2002.

Adobe Acrobat 6.0 Standard, Version 6.0.2, Screenshots, 2 pages, May 18, 2004.

U.S. Appl. No. 12/643,865, filed Dec. 21, 2009.

U.S. Appl. No. 12/703,476, filed Feb. 10, 2010.

U.S. Appl. No. 12/722,364, filed Mar. 11, 2010.

U.S. Appl. No. 12/792,547, filed Jun. 2, 2010.

U.S. Appl. No. 12/977,701, filed Dec. 23, 2010.

Honeywell Spyder Bacnet User's Guide, 242 pages, Revised Jul. 2009.

Honeywell Spyder User's Guide 202 pages, Released Jul. 2007.

http://blogs.msdn.com/b/khen1234/archive/2005/05/11/416392.aspx, "Regular Expressions in T-SQL," 4 pages, May 11, 2005.

http://en.wikipedia.org/wiki/JAR_(file_format), "JAR (file Format)—Wikipedia, the Free Encyclopedia," 3 pages, printed Dec. 26, 2009.

http://www.google.com/maps, "Google Maps, Pin Location," 1 page, prior to Nov. 21, 2008.

Microsoft Word Screen Shots, 2 pages, prior to Nov. 21, 2008.

Siemens, BACnet for DESIGO 27 pages, prior to Dec. 30, 2009.

Tridium, "NiagaraAX Product Model Overview," 7 pages, 2005.

Tridium, "Tridium & Niagara Framework Overview," 9 pages, prior to Oct. 28, 2008.

* cited by examiner

ALARM MANAGEMENT SYSTEM HAVING AN ESCALATION STRATEGY

BACKGROUND

The invention pertains to alarms and particularly to alarm management. More particularly, the invention pertains to bases for alarm management.

SUMMARY

The invention is an alarm management system that has an escalation strategy which may be applied to each state of an alarm and increase a level of escalation if a required action has not been taken in response to an alarm. This approach is for avoiding an overlooking of any alarms and for assuring closure of alarms as soon as possible. An alarm may be in one of several intermediate states. Each state may have a threshold which if exceeded escalates an alarm's urgency. Alarm notifications may be provided to recipients according to their preferences.

DESCRIPTION

Figure 1:
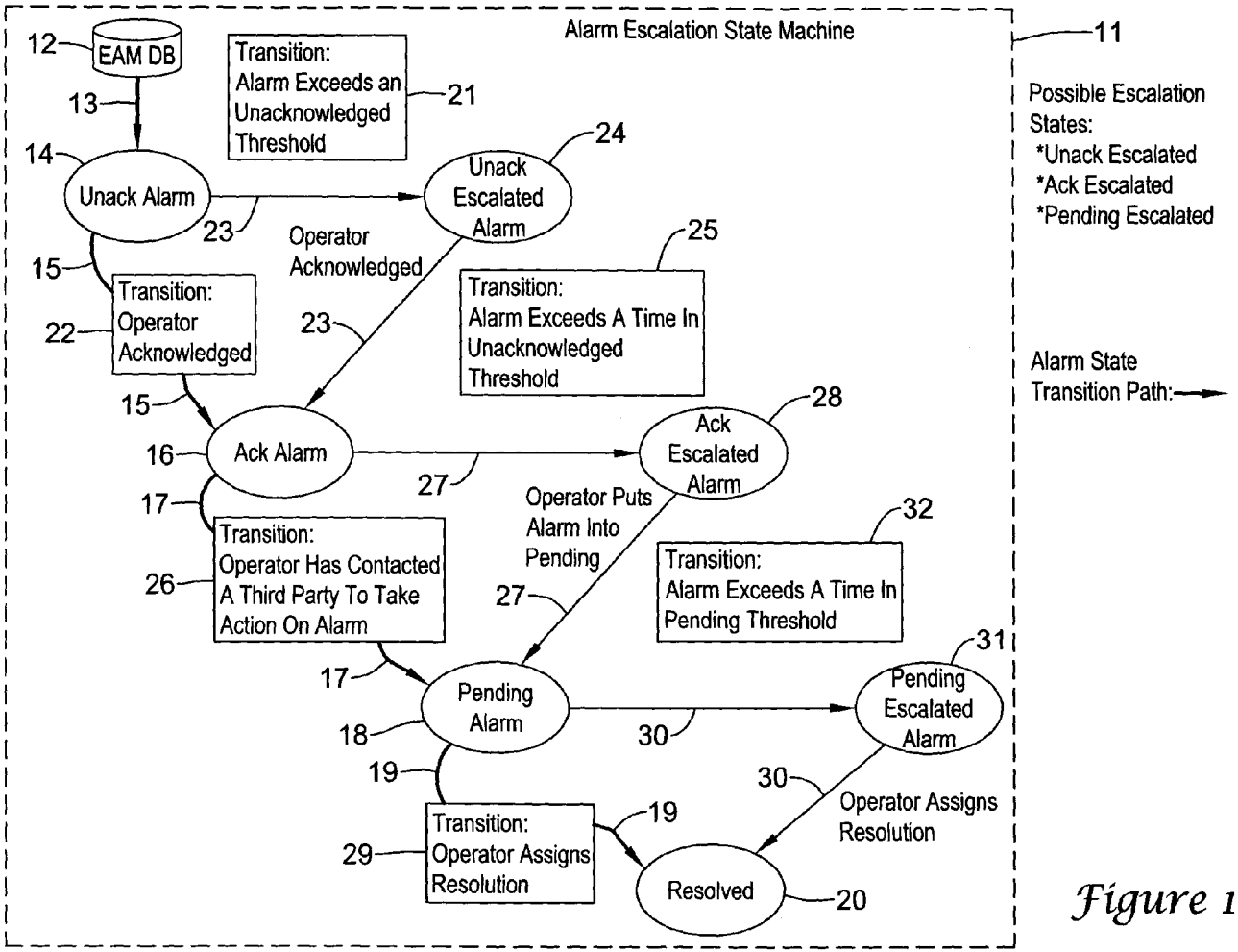
FIG. 1 is a diagram of alarm state transition paths and the corresponding escalation paths of an alarm escalation state machine.

A need to employ escalation strategies may be based on priorities of alarms, time-outs for alarms in a single state (unack/ack/pending/resolved) and frequencies of the alarms of the same type from the same source (recalled alarms). A strategy appears to be needed to ensure and guarantee than an alarm never gets overlooked, and that there is an efficient alarm state transition.

Although there may exist an escalation and notification system, there appears a need for an efficient and intelligent integrated escalation and notification system which can be configured, modified based on customers, alarm priorities, alarm states, and the frequency of occurrences of alarms. This need may be essentially required for a large operations group responsible for alarm management and handling of various different customers to meet its service level contract.

Many alarm management systems do not have very efficient alarm state transition strategies. Much of the time, alarms are just acknowledged and unacknowledged. During a normal life cycle of alarm, an alarm may go into various intermediate or other states, such as "UnAcknowledged", "Acknowledged", "Pending", "Resolved", and "Closed". Escalation may be an alarm state which can get associated with an alarm at each of these various intermediate states. There appears to be a need for an escalation strategy which is applied at each state of an alarm and which constantly increases the escalation level if a required action has not been taken. This may ensure a constant action on an alarm and an efficient alarm state transition, and eventually help in closing the alarm at the earliest moment.

There also appears to be a need for a reporting system which finds quickly the number of alarms that have not been closed as per the service level agreements. The reporting system may allow an administrator to monitor the operator efficiency in closing the alarms as per service level agreements. The reporting system may also help identify the trends, as well as provide analysis of some types of alarms which may take longer to close. The system may help in prognostics and efficient business decisions.

The present approach may involve creating escalation rules, and associating the escalation rules to the corresponding escalation services. The approach may also involve about how the escalation rules and services are evaluated at runtime for escalating the alarms. The present approach may provide an easy to use web user interface for configuring various escalation rules and services based on the service level agreements for an operator group. The reporting system may provide a predefined set of escalation parameters, but these parameters may be extended as per the needs of the operating group.

Alarm escalation may be a raising of the alarm's urgency, thus changing its handling based on a set of predefined rules. This may be required and initiated if an alarm has exceeded a specific threshold such as time as an alarm or time in an unacknowledged state. Escalation may be determined as regular on the entire set of active alarms, regardless of whether they are being viewed or not. In other words, escalation assessments may be independent of the user invoking a view that contains an alarm that has met an escalation threshold.

The system may support at least, but not be limited to, five levels of increasing escalation. The system may support a configuration of a set of various escalation rules for each customer.

Escalation rules may be tied to priority levels, so that each defined priority level may have its own set of escalation rules. For example, urgent or high priority alarms may be escalated rapidly, exposed to more individuals, and routed via a pager. Low priority alarms may be escalated more slowly or not at all.

The present approach may also indicate an association of the escalation services to a notification algorithm. Notification rules may also be user configurable where each escalation service can be attached with different notification rules. Notification rules may allow a configuration for notification based on user groups, notification time period, and frequency of the notification to be sent.

The approach may also have an unescalation of an alarm once proper action has been taken. This is to ensure that corrective action de-escalates the alarm, and that the alarm is returned back to the normal pool. There may be a provision for tracking the maximum escalation level that an alarm achieves during its lifecycle.

The present approach may include the following items: 1) Escalation strategies focused on an effective alarm state transition; 2) A provision for an unescalation of alarm; 3) Ease in configuring escalation services, and threshold and escalation notification rules; and 4) A highly extensible and flexible escalation strategy.

Some of the terms relating to the present approach may be noted herein. Alarm escalation may be the raising of an alarm's urgency and a manner of dispatch, based on a set of defined rules, without changing the alarm's inherent priority. Alarm notification may force the annunciation of an alarm to a designated person by a pre-determined communication method (e.g., telephone, web, email, and so forth). Escalated may indicate an alarm state where an alarm has exceeded some threshold such as age, where the user needs to be notified with greater salience. A threshold type may define the states and attributes on which the alarm escalation is based. There may be several (e.g., four) different threshold types defined in the system. The system may have the flexibility to add another threshold type at run time. There may be a time in an unacknowledged threshold, a time not in a pending threshold, a time in pending threshold exceeded, and a frequency threshold. A threshold period may be a certain amount of time associated with each of the threshold types.

The present approach may include the following items. A privileged user may have a right to create escalation service logs into the system. The user may navigate to the screen for creating escalation services. A user may be presented with an option to add an escalation service. The user may specify a name of the escalation service.

A user may be presented with an option to add an escalation level for the escalation service the user has just made in the system. The user should specify at least one escalation level for each escalation service. For each escalation level, there may be several different types of thresholds that may be monitored. The types may be "Not Acknowledged", "Not Pending", "Time in Pending", and "Frequency".

A user may select a time range for different types of thresholds. The user should provide at least one threshold time range for each escalation Level. The user may be presented with an option to set escalation notification rules. The user may select the escalation level for which escalation notification rules need to be defined.

The user may be asked to select the recipients (i.e., the alarm assignee/user group to which notification should be sent) whenever the escalation threshold crosses or exceeds the permissible range. The user may be presented with an option to select the frequency for the notification, i.e., once or repetitive. If the notification frequency is repetitive, then the user should select the repetitive period in terms of hours, minutes and days. The system may allow the modification for escalation services, threshold levels and notification rules as and when required. The system may allow the user to map the escalation service to the customer and a priority range. The user may select the customer and the user may be provided with an option to select the priority range and the escalation service. This may allow a coupling of escalation with the priority of an alarm.

A background timer component may be invoked periodically to assess the escalation services defined in the system. According to the time spent by an alarm in the system and the threshold specified by a user as a part of the escalation services, the update of an escalation level may happen on an alarm if it exceeds the threshold of the escalation level. Subsequently, the corresponding notifications may be generated which can be sent to the recipients based on their notification preferences.

The system may have an ability to de-escalate the alarms once an appropriate action is taken on the alarm. Alarms may again be a part of the normal pool and the escalation rules may be evaluated as general. The FIGS. 1 and 2 are diagrams which may graphically describe the legal states and transitions or triggers that cause state changes, and describe various escalation states.

Figure 2:
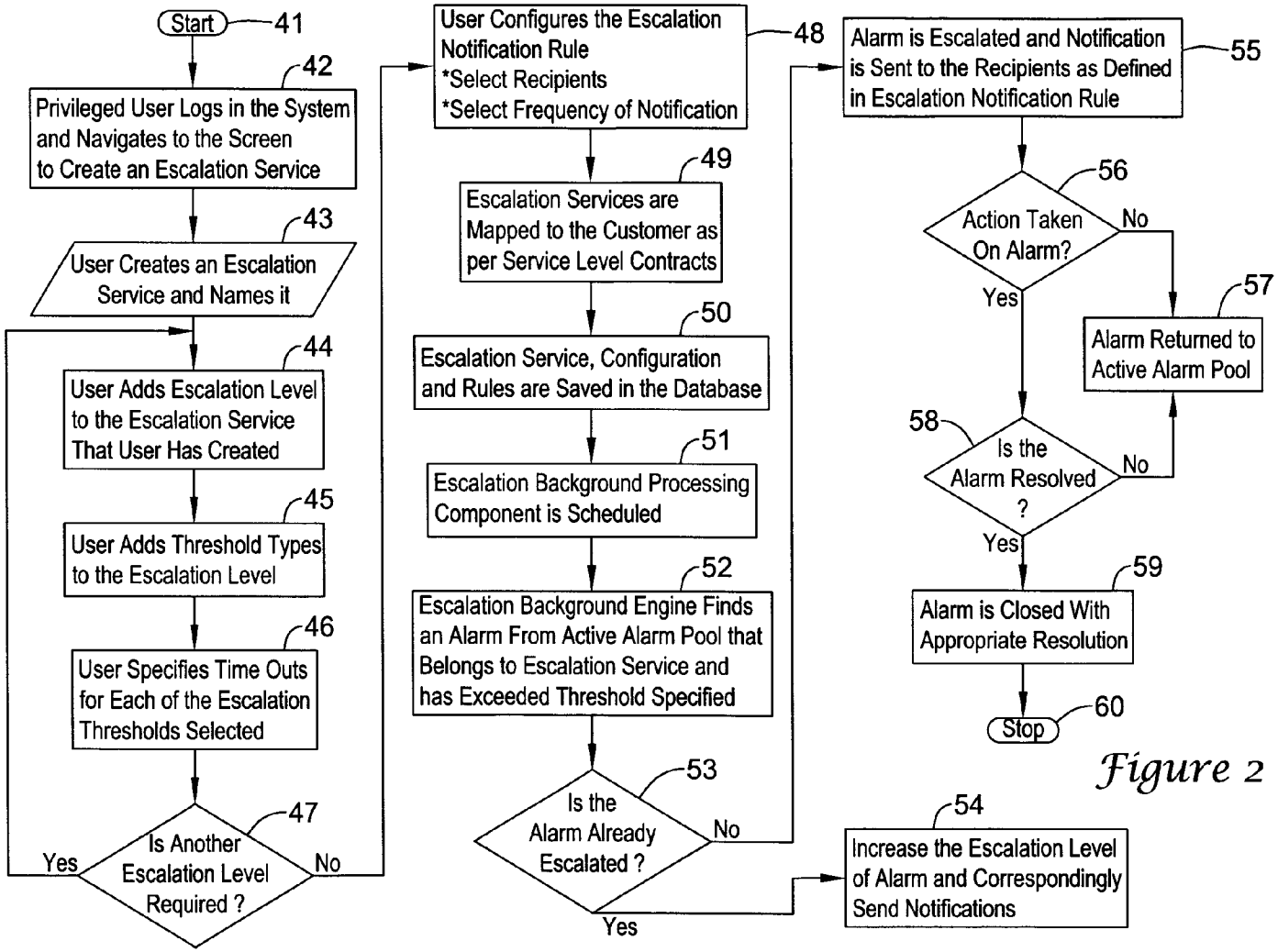
FIG. 2 is a flow diagram which shows various steps and processes needed for an alarm escalation strategy.

The diagram of FIG. 1 shows the alarm state transition paths and the corresponding escalation paths of an alarm escalation state machine 11. Machine 11 may have various alternate state transition paths also. For instance, an unacknowledged alarm may directly be resolved by an operator. In such an alternate transition path, an alarm state engine may automatically acknowledge and assign the alarms. This aspect may give the operator flexibility in making an alarm management decision and at the same time to maintain a consistent alarm state transition. Possible escalation states in machine 11 may include unack escalated, ack escalated and pending escalated. From an EAM database 12 may come an unack alarm at symbol 14 via a transition path 13. The alarm state transition 13 may be that the alarm exceeds an unacknowledged threshold as indicated in symbol 21. From the unack alarm at symbol 14 may come an ack alarm at symbol 16 via a transition path 15. The transition for path 15 may be operator acknowledged at symbol 22. A path 23 may be from symbol 14 to a symbol 24 which indicates an unack escalated alarm. The path 23 may be operator acknowledged. The transition of path 23 may be that an alarm exceeds a time in an acknowledged threshold as indicated in symbol 25.

From the ack alarm at symbol 16 may come a pending alarm at symbol 18 via a transition path 17. A path 17 transition may be indicated in symbol 26 as that the operator has contacted a third party to take action on the alarm. A path 27 may be from symbol 16 to a symbol 28 which indicates an ack escalated alarm. The path 27 may be where the operator puts the alarm in as a pending alarm, at symbol 19.

From the pending alarm at symbol 18 may come a resolved state at symbol 20 via a transition path 19. A path 19 transition may be indicated in symbol 29 that the operator assigns a resolution. A path 30 may be from symbol 18 to a symbol 31 which indicates a pending escalated alarm. A transition of path 30 may be that the alarm exceeds a time in a pending threshold as indicated at symbol 32. The path 30 may continue on from symbol 31 to symbol 20 where the operator assigns a resolution of the alarm.

The diagram of FIG. 2 is a flow chart which signifies various steps and processes that will be required for an effective and efficient alarm escalation strategy. For the more part, the steps may be in numerical order. After start symbol 41 may be a privileged user logging in the system and navigating to a screen to create an escalation service at symbol 42. The user may create an escalation service and name the service at symbol 43. At symbol 44, the user may add an escalation level to the escalation service that the user has created. The user may add threshold types to the escalation level at symbol 45. The user may specify time-outs for each of the escalation thresholds selected at symbol 46.

At symbol 47, a question is whether another escalation level is required. If the answer is yes, then one may go through the steps as indicated by symbols 44-46. If the answer is no, then the user may configure the escalation notification rule by selecting the recipients and the frequency of notification at symbol 48. Escalation services may be mapped to the customer as per service level contracts at symbol 49. According to symbol 50, the escalation service, configuration and rules may be saved in the database. The escalation background processing component may be scheduled at symbol 51. At symbol 52, the escalation background engine may find an alarm from an active alarm pool that belongs to an escalation service and has exceeded the threshold specified.

At symbol 53, a question is whether the alarm is already escalated. If the answer is yes, then the escalation level of the alarm may be increased and notifications correspondingly sent at symbol 54. If the answer is no, then the alarm may be escalated and notification sent to he recipients as defined in the escalation notification rule, according to symbol 55.

At symbol 56, a question is whether action is taken on the alarm. If the answer is no, then the alarm may be returned to the active alarm pool at symbol 57. If the answer is yes to the question at symbol 56, then at symbol 58, a question is whether the alarm is resolved. If the answer is no to the question at symbol 58, then the alarm may be returned to the active alarm pool at symbol 57. If the answer is yes to the question at symbol 58, then the alarm may be closed with an appropriate resolution at symbol 59. After symbol 59, the approach may stop at symbol 60.

In the present specification, some of the matter may be of a hypothetical or prophetic nature although stated in another manner or tense.

Although the present system has been described with respect to at least one illustrative example, many variations and modifications will become apparent to those skilled in the art upon reading the specification. It is therefore the intention that the appended claims be interpreted as broadly as possible in view of the prior art to include all such variations and modifications.

What is claimed is:

1. An alarm management system comprising:

an escalation service for alarms; and wherein:

the escalation service comprises one or more urgency levels, each urgency level having one or more threshold types wherein each threshold type has a predetermined limit; and wherein the escalation service is configured to escalate an alarm from a first urgency level to a second urgency level if the alarm has exceeded the predetermined limit of a select threshold type.

2. The system of claim 1, wherein the escalation service further comprises an escalation notification rule.

3. The system of claim 2, wherein the notification rule indicates:

select recipients; and select frequency of notification.

4. The system of claim 2, further comprising an escalation background engine.

5. The system of claim 4, wherein the escalation background engine is for finding an alarm from an active alarm pool that belongs to the escalation service.

6. The system of claim 5, wherein the alarm has exceeded the set limit of a threshold type.

7. The system of claim 6, wherein:

if the alarm is not escalated, then the alarm is escalated; and a notification is sent to the select recipients.

8. The system of claim 7, wherein if action is not taken on the alarm, then the alarm is returned to the active alarm pool.

9. The system of claim 7, wherein:

if action is taken on the alarm, then the alarm is either resolved or not resolved;

if the alarm is not resolved, then the alarm is returned to the active alarm pool; and if the alarm is resolved, then the alarm is closed with an appropriate resolution.

10. The system of claim 1, wherein:

if the alarm is escalated, then an escalation level of the alarm is increased; and if the escalation level is increased, then a notification is sent to the select recipients.

11. An alarm escalation approach comprising:

an unacknowledged alarm appearing from a pool of alarms;

the alarm exceeding an unacknowledged threshold;

the unacknowledged alarm becoming an unacknowledged escalated alarm;

the unacknowledged alarm becoming an acknowledged alarm;

a notification being issued for action to be taken on the alarm;

the acknowledged alarm becoming acknowledged escalated alarm;

the acknowledged escalated alarm becoming a pending alarm;

the alarm exceeding a pending threshold;

the alarm becoming a pending escalated alarm;

the alarm being assigned a resolution; and the alarm is closed and returned to the alarm pool; and wherein being escalated means an increase in urgency.

* * * * *